US010443380B2

(12) United States Patent
Fan et al.

(10) Patent No.: US 10,443,380 B2
(45) Date of Patent: Oct. 15, 2019

(54) ASYMMETRIC SUPPORT STRUCTURE OF ENTRY DRIVEN ALONG GOB-SIDE UNDER UNSTABLE ROOF IN DEEP MINES AND CONSTRUCTION METHOD THEREOF

(71) Applicant: SHANDONG UNIVERSITY OF SCIENCE AND TECHNOLOGY, Qingdao (CN)

(72) Inventors: Kegong Fan, Qingdao (CN); Chunyuan Jing, Qingdao (CN); Shengming Niu, Qingdao (CN); Deli Fan, Qingdao (CN); Chuanwei Zang, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 16/319,880

(22) PCT Filed: Oct. 31, 2017

(86) PCT No.: PCT/CN2017/108695
§ 371 (c)(1),
(2) Date: Jan. 23, 2019

(87) PCT Pub. No.: WO2018/133492
PCT Pub. Date: Jul. 26, 2018

(65) Prior Publication Data

US 2019/0218910 A1 Jul. 18, 2019

(30) Foreign Application Priority Data

Jan. 23, 2017 (CN) ..... 2017 1 0057785

(51) Int. Cl.
*E21D 11/00* (2006.01)
*E21D 11/15* (2006.01)

(52) U.S. Cl.
CPC ..... *E21D 11/152* (2013.01); *E21D 11/155* (2013.01)

(58) Field of Classification Search
CPC ..... E21D 11/152; E21D 11/155
See application file for complete search history.

(56) References Cited

U.S. PATENT DOCUMENTS 4,413,928 A * 11/1983 Tucker ..... E21D 20/02 405/259.5
5,096,335 A * 3/1992 Anderson ..... E21D 11/152 405/150.1

(Continued)

FOREIGN PATENT DOCUMENTS

CN 1083896 A 3/1994
CN 103244122 A 8/2013

(Continued)

OTHER PUBLICATIONS

International Search Report (Forms PCT/ISA/210) dated Jan. 18, 2018 by the State Intellectual Property Office of People's Republic of China in corresponding International Application No. PCT/CN2017/108695 and English translation of the International Search Report. (8 pages).

(Continued)

*Primary Examiner* — Benjamin F Fiorello
(74) *Attorney, Agent, or Firm* — Buchanan Ingersoll & Rooney PC

(57) ABSTRACT

An asymmetric support structure of entry driven along gob-side (EDG) under unstable roof in deep mines and construction method thereof. The asymmetric support structure includes roadway roof support structure, a gob-side support structure and a solid coal seam-side support structure. The roadway roof support structure includes a reinforcing wire mesh, a W-section steel strap, high-strength pretensioned bolts, and cable bolts and matching steel straps.

(Continued)

The gob-side support structure includes a reinforcing wire mesh, a W-section steel strap, high-strength pretensioned yielding bolts and grouting cable bolts and its matching steel straps. The solid coal seam-side support structure includes a reinforcing wire mesh, a reinforced beam and steel strap pallet subassembly, high-strength pretensioned yielding bolts and cable bolts and its matching steel straps. The roadway roof support structure, gob-side support structure and solid coal seam-side support structure beneficially together form the asymmetric support structure.

10 Claims, 2 Drawing Sheets

(56) References Cited

U.S. PATENT DOCUMENTS

| | | | | | |
|---|---|---|---|---|---|
| 5,462,391 | A * | 10/1995 | Castle | E21D 11/006 | 405/259.1 |
| 5,466,095 | A * | 11/1995 | Scott | E21D 11/006 | 405/259.1 |
| 5,934,990 | A * | 8/1999 | Steffenino | E21F 17/103 | 454/170 |
| 5,957,627 | A * | 9/1999 | Stankus | E21D 11/006 | 405/259.1 |
| 8,696,251 | B2 * | 4/2014 | Potvin | E21D 19/00 | 405/272 |
| 2010/0054870 | A1 * | 3/2010 | Stankus | E21D 11/006 | 405/288 |

FOREIGN PATENT DOCUMENTS

| | | | |
|---|---|---|---|
| CN | 204186395 | U | 3/2015 |
| CN | 104806275 | A | 7/2015 |
| CN | 104879150 | A | 9/2015 |
| CN | 205422777 | U | 8/2016 |
| CN | 106894833 | A | 6/2017 |
| RU | 2 369 742 | C1 | 10/2009 |

OTHER PUBLICATIONS

Written Opinion of the International Searching Authority (Form PCT/ISA/237) dated Jan. 18, 2018 by the State Intellectual Property Office of People's Republic of China in corresponding International Application No. PCT/CN2017/108695. (4 pages).

Notice of the Opinion on the First Examination dated Jan. 19, 2018, by the State Intellectual Property Office of the People's Republic of China in corresponding Chinese Patent Application No. 201710057785.X and an English translation of the Notice. (9 pages).

Notification to Grant Patent Right for Invention dated Feb. 24, 2018, by the State Intellectual Property Office of the People's Republic of China in corresponding Chinese Patent Application No. 201710057785.X. (1 page).

* cited by examiner

ASYMMETRIC SUPPORT STRUCTURE OF ENTRY DRIVEN ALONG GOB-SIDE UNDER UNSTABLE ROOF IN DEEP MINES AND CONSTRUCTION METHOD THEREOF

FIELD OF THE INVENTION

The invention pertains to the field of roadway support technology of entry driven along gob-side for deep mining of coal mines, and more particularly relates to an asymmetric support structure of entry driven along gob-side under unstable roof in deep mines and construction method thereof.

BACKGROUND OF THE INVENTION

With the development of coal mining technology and the importance of the coal recovery ratio, the entry driven along gob-side has been currently employed in most of mining roadways of mines, with narrow coal pillars reserved along the edge of gob (waste coal) of nearby coal faces, having narrow coal pillars along the gob at one side of the roadway and the seam at the other side, characterized by the asymmetric structure of surrounding rock. With the increased mining intensity, an often encountered problem is that narrow coal pillars must be reserved for gob-side entry driven of the gate entry, as the overlying strata movement never stops after the mining of nearby coal faces, and such gob-side entry driving project may be affected by the lateral movement of overlying strata on nearby coal faces, giving rise to serious deformation and failure of roadway surrounding rock. Moreover, as the mining process goes deeper, the stress concentration of narrow coal pillars is aggravated, highlighting the disequilibrium of deformation and failure at the roadway's sides along the gob. The existing support pattern of entry driven along gob-side still commonly adopts symmetrical support of equal intensity, and fails to adapt to the asymmetric characteristics of surrounding rock structure for entry driven along gob-side and the loading features of narrow coal pillars under the dynamic pressure effect, giving rise to serious deformation and failure of roadway surrounding rock.

SUMMARY OF THE INVENTION

The disclosure here involves an asymmetric support structure of entry driven along gob-side under an unstable roof in (relatively) deep mines. That is, the asymmetric support structure helps control the surrounding rock deformation of entry driven along gob-side.

The disclosed asymmetric support structure of entry driven along gob-side under unstable roof in deep mines includes a roadway roof support structure and an asymmetric support structure at roadway's sides; the roadway roof support structure comprises a reinforcing wire mesh, a W-section steel strap, high-strength pretensioned bolts and cable bolts and its matching steel straps consisting of cable bolts and steel straps, wherein the reinforcing wire mesh clings to the roadway roof, the W-section steel strap is arranged outside the reinforcing wire mesh, a plurality of high-strength pretensioned bolts vertically pass through the W-section steel strap and the reinforcing wire mesh, and the anchor ends of high-strength pretensioned bolts are connected into the roadway roof, two cable holes are provided at the steel strap's ends, the cable bolts pass through the cable holes and the reinforcing wire mesh, the anchor ends of cable bolts are connected into the relatively stable strata above the main roof and inclined to the seam-side; the asymmetric support structure at roadway's sides can control releasing rock pressure partly, comprising a gob-side support structure and a solid coal seam-side support structure; the gob-side support structure comprises a reinforcing wire mesh, a W-section steel strap, high-strength pretensioned yielding bolts and grouting cable bolts and its matching steel straps consisting of cable bolts and steel straps, wherein the reinforcing wire mesh clings to the gob-side, the W-section steel strap is arranged outside the reinforcing wire mesh, a plurality of high-strength pretensioned yielding bolts vertically pass through the W-section steel strap and the reinforcing wire mesh, and the anchor ends of high-strength pretensioned yielding bolts are connected into the gob-side, cable holes are provided at the steel strap's ends, the grouting cable bolts pass through the cable holes and the reinforcing wire mesh, and the anchor ends of grouting cable bolts are connected into the gob-side; the solid coal seam-side support structure comprises a reinforcing wire mesh, a reinforced beam and steel strap pallet subassembly, high-strength pretensioned yielding bolts and cable bolts and its matching steel straps consisting of cable bolts and steel straps, wherein the reinforcing wire mesh clings to the seam-side, the reinforced beam and steel strap pallet subassembly is arranged outside of the reinforcing wire mesh, a plurality of high-strength pretensioned yielding bolts vertically pass through the reinforced beam and steel strap pallet subassembly and the reinforcing wire mesh, and the anchor ends of high-strength pretensioned yielding bolts are connected into the seam-side, cable holes are provided at the steel strap's ends, the cable bolts pass through the cable holes and the reinforcing wire mesh, and the anchor ends of cable bolts are connected into the seam-side.

Further, the asymmetric support structure may additionally comprises bolts in the corner with their anchor ends arranged in the roadway roof and floor.

Further, in the roadway roof support structure, a plurality of high-strength pretensioned bolts may be in a row, and a cable bolt is arranged every other row thereof.

Further, the cable bolts may be kept alternately close to the middle of roadway nearby the gob-side, and the grouting cable bolts and its matching steel straps may be arranged along the long axis direction of the roadway.

Further, in the gob-side support structure, a plurality of high-strength pretensioned yielding bolts may be in a row, and grouting cable bolts and its matching steel straps are arranged every two rows thereof; in the solid coal seam-side support structure, a plurality of high-strength pretensioned yielding bolts may be in a row, and grouting cable bolts and its matching steel straps may be arranged every two rows thereof.

Further, in the gob-side support structure, the grouting cable bolts and its matching steel straps may be arranged in the middle-upper part of gob-side; in the seam-side support structure, the grouting cable bolts and its matching steel straps may be arranged in the upper part of seam-side.

Further, in the gob-side support structure, the length of grouting cable bolts may be ⅗ of the width of the narrow coal pillar.

Further, in the solid coal seam-side support structure, the anchor ends of cable bolts may be in the vicinity or outside of the lateral abutment pressure peaks of adjacent coal faces.

Furthermore, in the roadway roof support structure and the solid coal seam-side support structure, the cable bolts may consist of steel strand and several birdcages.

The disclosure also involves a construction method of an asymmetric support structure of entry driven along gob-side under unstable roof in deep mines, constituting the asymmetric support structure described above using the following steps:

Step 1: drilling bolt holes on the roadway roof, arranging the reinforcing wire mesh and W-section steel strap, and mounting the high-strength pretensioned bolts;

Step 2: drilling bolt holes on the gob-side, arranging the reinforcing wire mesh and W-section steel strap, and mounting the high-strength pretensioned yielding bolts;

Step 3: drilling bolt holes on the seam-side, arranging the reinforcing wire mesh, reinforced beam and steel strap pallet subassembly, and mounting the high-strength pretensioned yielding bolts;

Step 4: drilling cable holes on the roadway roof and mounting the steel straps and cable bolts thereon; drilling cable holes on the gob-side and mounting the steel girder and grouting cable bolts thereon; drilling cable holes on the seam-side and mounting the steel straps and cable bolts thereon, and carrying out grouting reinforcement to the grouting cable bolts on the gob-side.

Compared with the existing technology, the asymmetric support structure of entry driven along gob-side under unstable roof in deep mines and construction method thereof disclosed here have the following features and advantages:

1. The asymmetric support structure of entry driven along gob-side under unstable roof in deep mines includes the roadway roof support structure, gob-side support structure and solid coal seam-side support structure, which can control effectively the roadway surrounding rock deformation and failure of entry driven along gob-side under an unstable roof in deep mines.

2. In some embodiments, in the roadway roof support structure, the cable bolts and its matching steel straps are arranged close to the middle of roadway nearby the gob-side, with the anchor ends of cable bolts close to seam-side, thereby making the upper stable surrounding rock of entry driven along gob-side playing a role effectively, minimizing the sinkage of roof, and improving the stress state of narrow coal pillar;

3. In some embodiments, the gob-side support structure arranged in the narrow coal pillar consists of the high-strength pretensioned yielding bolts and grouting cable bolts and its matching steel straps, which not only increases the supporting intensity to the gob-side, but also controls releasing rock pressure partly, and improves effectively the disequilibrium of roadway surrounding rock deformation and failure of deep entry driven along gob-side;

4. The construction method using asymmetric support structure of entry driven along gob-side under unstable roof in deep mines disclosed here can achieve safe and effective results.

By referring to the Description of the Preferred Embodiments in conjunction with the Drawings, the features and advantages of the invention will be more evident.

BRIEF DESCRIPTION OF THE DRAWINGS

For the purpose of illustrating more clearly the technical solution in the embodiments, the following brief descriptions are provided (as elaborated on in the description of embodiments below); obviously, the drawings in the following description are some embodiments of the invention, yet the ordinary persons skilled in the art may, free from any creative work, further obtain other drawings based on these Drawings.

DESCRIPTION OF THE PREFERRED EMBODIMENTS

Figure 1:
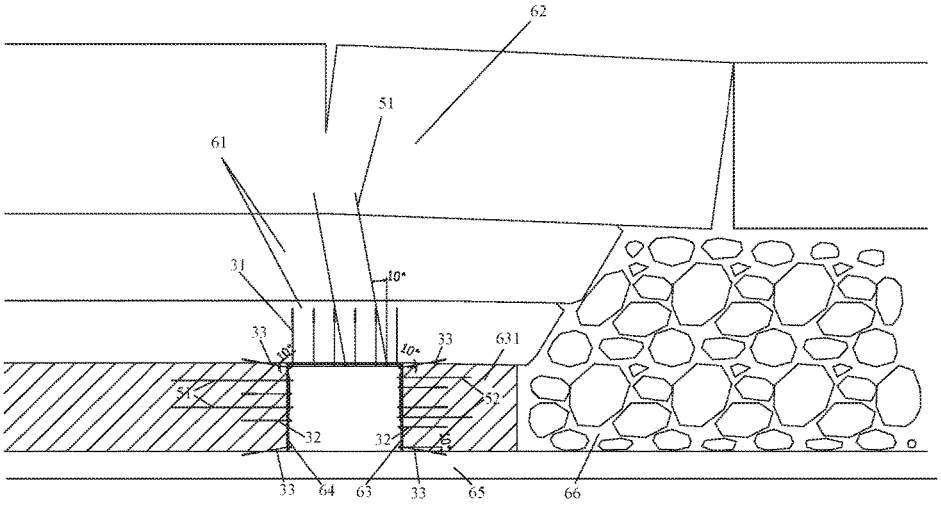
FIG. 1 is a sectional view of an asymmetric support structure of entry driven along gob-side under an unstable roof in deep mines in an embodiment.
Figure 2:
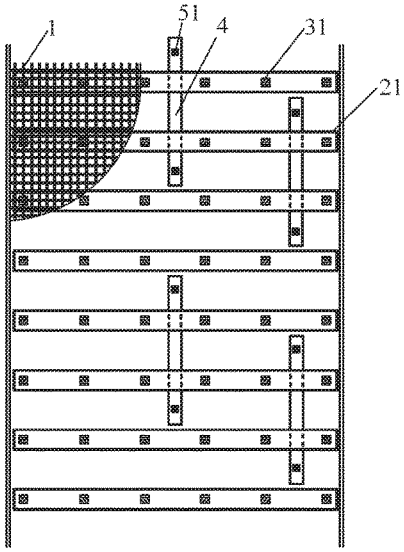
FIG. 2 shows the schematic diagram of an embodiment of a roadway roof support structure.
Figure 3:
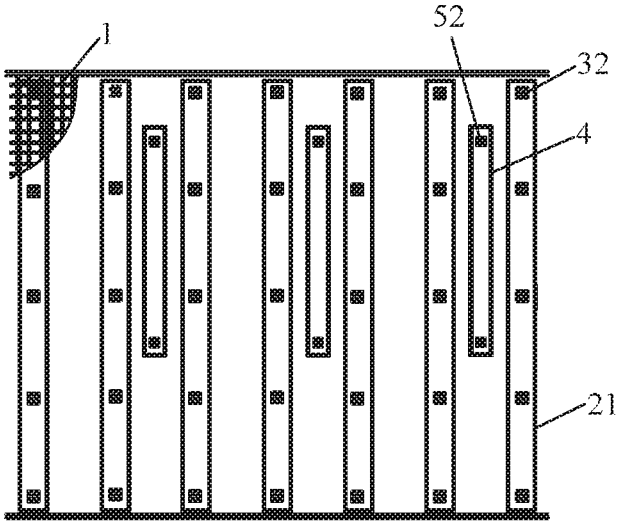
FIG. 3 illustrates the schematic diagram of an embodiment of a gob-side support structure.
Figure 4:
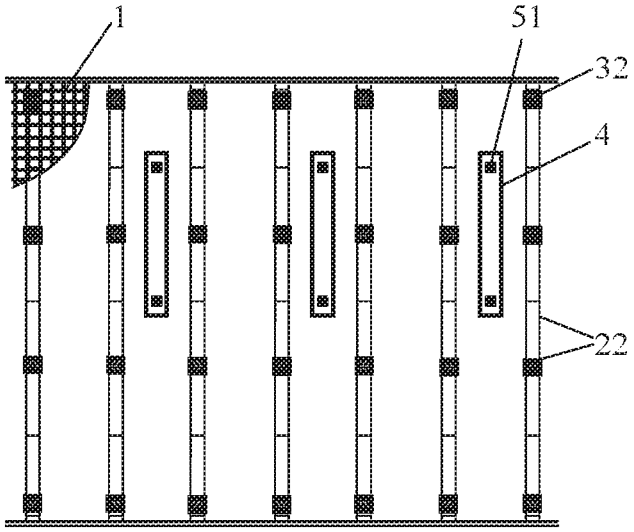
FIG. 4 shows the schematic diagram of an embodiment of a solid coal seam-side support structure.

As shown in FIG. 1-4, in the "asymmetric support structure of entry driven along gob-side under unstable roof in deep mines", "deep" refers to the working face with a mining depth of more than 800 m or the depth where the engineering rock mass suffers from nonlinear mechanics phenomena and the depth intervals below; "unstable roof" means that the lateral strata movement of main roof does not stop after the mining of nearby coal faces, resulting in the lateral stress redistribution yet to be unstable arising from mining. During the "entry driven along gob-side", the narrow coal pillar (631) of gob-side (63) has a width of 5 m-6 m, and the outside thereof is the gob (66) as shown in FIG. 1. Furthermore, "asymmetric support" means that different supporting intensities and structures are imparted on the roadway roof (61), gob-side (63) and seam-side (64) depending on the structural features and deformation and failure characteristics of surrounding rock for entry driven along gob-side. The gob-side (63) and seam-side (64) are thereby supported, allowing for the integrally outward bulge and slippage of the narrow coal pillar (631) thereof and the seam-side (64) arising from the stress concentration and mine ground pressure, and further, the gob-side (63) and the seam-side (64) shall be supported so as to have certain intensity and yielding function, and control releasing rock pressure partly.

The embodiment provides an asymmetric support structure of entry driven along gob-side under unstable roof in deep mines, comprising a roadway roof support structure and an asymmetric support structure at roadway's sides. The latter can control releasing rock pressure partly, comprising a gob-side support structure and a seam-side support structure with different support structures and intensities. The roadway roof support structure is composed of a reinforcing wire mesh (1), a W-section steel strap (21), high-strength pretensioned bolts (31), steel straps (4) and cable bolts (51). Several high-strength pretensioned bolts (31) and the W-section steel strap (21) constitute a combined support unit in order to support the shallow surrounding rock. Two cable bolts (51) and steel straps (4) form a support unit of cable bolts and its matching steel straps, in order to support the deep surrounding rock. The reinforcing wire mesh (1) clings to the roadway roof (61), the W-section steel strap (21) is arranged outside the reinforcing wire mesh (1), a plurality of high-strength pretensioned bolts (31) vertically pass through the W-section steel strap (21) and the reinforcing wire mesh (1), and the anchor ends of high-strength pretensioned bolts (31) are connected into the roadway roof (61), cable holes are provided at the steel strap's ends (4), the cable bolts (51) pass through the cable holes and the reinforcing wire mesh (1), the anchor ends of cable bolts (51) are connected into the relatively stable strata (62) in the main roof (61). The cable bolts (51) are bird's nest ones, with at least 3 bird's nests at the ends, having a diameter of not less than 17.8 mm and a tensile strength of 1,860 MPa. The anchor ends of cable bolts (51) incline toward the seam-side (64), preferably 10° thereto relative to the direction perpendicular to the roadway roof (61). In the roadway roof support structure, a plurality of high-strength pretensioned bolts (31) are arranged in a row, a cable bolt (51) is arranged every other row thereof and close to the middle of roadway nearby the gob-side (63); the steel straps (4) are in two rows and alternately arranged in the direction where the roadway extends. The reinforcing wire mesh (1) functions as full wrapping to the roadway roof (61), the high-strength pretensioned bolts (31) and the W-section steel strap (21) play a role of supporting the shallow surrounding rock, and the cable bolts (51) and the steel straps (4) are used for supporting deep surrounding rock.

The gob-side support structure comprises a reinforcing wire mesh (1), a W-section steel strap (21), high-strength pretensioned yielding bolts (32), steel straps (4) and grouting cable bolts (52). A plurality of high-strength pretensioned yielding bolts (32) and the W-section steel strap (21) form a combined support unit, to constitute the pretensioned bearing structure. Two grouting cable bolts (52) and the steel straps(4) form a support unit of grouting cable bolts and its matching steel straps, for the purpose of reinforcing the overall support effect. The length of grouting cable bolts (52) is ⅗ of the width of the narrow coal pillar (631) for the gob-side (63). The reinforcing wire mesh (1) clings to the gob-side (63), the W-section steel strap (21) is arranged outside the reinforcing wire mesh (1), a plurality of high-strength pretensioned yielding bolts (32) vertically pass through the W-section steel strap (21) and the reinforcing wire mesh (1), and the anchor ends of high-strength pretensioned yielding bolts (32) are connected into the gob-side (63). Cable holes are provided at the steel strap's ends (4), the grouting cable bolts (52) pass through the cable holes and the reinforcing wire mesh (1), and the anchor ends of grouting cable bolts (52) are connected into the gob-side (63). In the gob-side support structure, a plurality of high-strength pretensioned yielding bolts (32) are arranged in a row, the steel straps (4) are arranged every two rows thereof and vertically provided in the middle-upper part of gob-side (63). The reinforcing wire mesh (1) functions as full wrapping to the gob-side (63), the high-strength pretensioned yielding bolts (32) and the W-section steel strap (21) form the pretensioned bearing structure, the layout density of high-strength pretensioned yielding bolts (32) in the gob-side (63) is larger than that in the seam-side (64), and the grouting cable bolts (52) and the steel straps (4) are used for strengthening the overall effect of support.

The seam-side support structure comprises a reinforcing wire mesh (1), a reinforced beam and steel strap pallet subassembly (22), high-strength pretensioned yielding bolts (32), steel straps (4) and cable bolts (51). A plurality of high-strength pretensioned yielding bolts (32) and the reinforced beam and steel strap pallet subassembly (22) form a combined support unit, to constitute the pretensioned bearing structure. Two anchor cables (51) and the steel straps (4) form a support unit of cable bolts and its matching steel straps, for the purpose of reinforcing the overall support effect. The reinforcing wire mesh (1) clings to the seam-side (64), the reinforced beam and steel strap pallet subassembly (22) is arranged outside the reinforcing wire mesh (1), a plurality of high-strength pretensioned yielding bolts (32) vertically pass through the reinforced beam and steel strap pallet subassembly (22) and the reinforcing wire mesh (1), and the anchor ends of high-strength pretensioned yielding bolts (32) are connected into the seam-side (64) under the high-strength pre-stress, cable holes are provided at the steel strap's ends (4), the anchor cables (51) pass through the cable holes and the reinforcing wire mesh (1), and the anchor ends of anchor cables (51) are connected into the seam-side (64) and are in the vicinity of or outside of the lateral abutment pressure peaks of nearby coal faces. The cable bolts (51) are bird's nest ones, with at least 3 bird's nests at the ends, having a diameter of not less than 17.8 mm and a tensile strength of 1,860 MPa. In the seam-side support structure, a plurality of high-strength pretensioned yielding bolts (32) are arranged in a row, the steel straps (4) are arranged every two rows thereof and vertically provided in the middle-upper part of seam-side (64). The reinforcing wire mesh (1) functions as full wrapping to the seam-side (64), the high-strength pretensioned yielding bolts (32) and the reinforced beam and steel strap pallet subassembly (22) form the pretensioned bearing structure, and the cable bolts (51) and the steel straps (4) are used for strengthening the overall effect of support.

The asymmetric support structure of entry driven along gob-side under unstable roof in deep mines in the embodiment additionally comprises bolts in the corner (33) with their anchor ends arranged in the rock strata of roadway roof (61) or floor (65), and preferably, the bolts in the corner have a dip angle of 10° with both the rock bedding plane of roadway roof (61) and floor (65).

In the asymmetric support structure of entry driven along gob-side under unstable roof in deep mines in the embodiment, the roadway roof support structure can effectively play a role of upper stable strata (62) of entry driven along gob-side, minimize the sinkage of roadway roof (61), and improve the stress state of narrow coal pillar (631) for entry protection; the gob-side support structure not only increases the supporting intensity of gob-side (63), but also controls releasing rock pressure partly, improving effectively the disequilibrium of roadway surrounding rock deformation and failure of deep entry driven along gob-side; the roadway roof support structure, gob-side support structure and solid coal seam-side support structure form together the asymmetric support structure, so as to control effectively the roadway surrounding rock deformation and failure of entry driven along gob-side under unstable roof in deep mines.

The embodiment also provides a construction method of asymmetric support structure of entry driven along gob-side under unstable roof in deep mines, constituting the asymmetric support structure according to Claims above using the following steps:

Step 1: drilling bolt holes on the roadway roof (61), arranging the reinforcing wire mesh (1) and W-section steel strap (21), and mounting the high-strength pretensioned bolts (31);

Step 2: drilling bolt holes on the gob-side (63), arranging the reinforcing wire mesh (1) and W-section steel strap (21), and mounting the high-strength pretensioned yielding bolts (32);

Step 3: drilling bolt holes on the seam-side (64), arranging the reinforcing wire mesh (1), reinforced beam and steel strap pallet subassembly (22), and mounting the high-strength pretensioned yielding bolts (32);

Step 4: drilling cable holes on the roadway roof (61) and mounting the steel straps (4) and cable bolts (51) thereon; drilling cable holes on the gob-side (63) and mounting the steel straps (4) and grouting cable bolts (52) thereon; drilling cable holes on the seam-side (64) and mounting the steel straps (4) and cable bolts (51) thereon, and carrying out grouting reinforcement to the grouting cable bolts (52) on the gob-side.

In Steps 1, 2 and 3, the positioning, diameters and angles of the bolt holes are expected to satisfy the design requirements, and prior to the erection of the high-strength pretensioned bolts (31) and high-strength pretensioned yielding bolts (32), the rock dust and coal fines shall be removed from the bolt holes, the anchoring agents are placed in the quantity and order as required by the design, and an anti-friction washer must be provided between the cable bolt plate and nut, so that the high-strength pretensioned bolts (31) and high-strength pretensioned yielding bolts (32) must be mounted to achieve the design pretension stress.

In Step 4, the positioning, diameters and angles of the cable holes are expected to satisfy the design requirements, and prior to the erection of the cable bolts (51) and grouting cable bolts (52), the rock dust and coal fines shall be removed from the cable holes, and the cable bolts (51) and grouting cable bolts (52) must be mounted by applying the design pretension stress.

The construction method of asymmetric support structure in the embodiment first constructs the high-strength pretensioned bolts on the roadway roof (61), beneficial to the formation of a safe environment; timely constructing the high-strength pretensioned yielding bolts on the gob-side and applying the design pretension stress can improve the stability of narrow coal pillars (631); the cable bolts and grouting cable bolts are constructed and anchored after the erection of the high-strength pretensioned bolts and high-strength pretensioned yielding bolts, which is conducive to the synergistic support of the high-strength pretensioned bolts, high-strength pretensioned yielding bolts, cable bolts and grouting cable bolts, improving the safety and effects of support.

The above description is not a restriction to the claimed invention, which is not limited to the aforementioned examples; instead, any change, modification, addition or substitution made by technicians in the substantive scope of the claims shall also pertain to the scope of protection of the invention

What is claimed:

1. An asymmetric support structure of entry driven along gob-side under an unstable roof configured for support in deep mines, comprising:

a roadway roof support structure supporting a roadway roof comprising sides, the roadway roof support structure comprising a first reinforcing wire mesh, a first W-section structure, and first matching structure, the W-section structure being comprised of steel straps, high-strength pretensioned bolts and cable bolts and the first matching structure being comprised of matching steel straps and cable bolts;

an asymmetric support structure at the sides of the roadway roof, wherein the reinforcing wire mesh of the roadway roof support structure clings to the roadway roof, the steel straps of the first W-section structure are arranged outside the reinforcing wire mesh of the roadway roof support structure, the high-strength pretensioned bolts vertically pass through the steel straps of the first W-section structure and the first reinforcing wire mesh, and anchor ends of the high-strength pretensioned bolts are connected into the roadway roof, first cable holes are provided at ends of the steel strap of the first W-section structure, the cable bolts passing through the first cable holes and the first reinforcing wire mesh, the anchor ends of the cable bolts being connected into relatively stable strata of the roadway roof and inclined to a seam-side, the asymmetric support structure at the sides of the roadway roof being configured to perform controlled release of rock pressure, the asymmetric support structure comprising a gob-side support structure and a solid coal seam-side support structure;

the gob-side support structure comprising a second reinforcing wire mesh, a second W-section structure, and a second matching structure, the second W-section structure being comprised of steel straps, high-strength pretensioned yielding bolts and grouting cable bolts, the second matching structure being comprised of matching steel straps and cable bolts, wherein the second reinforcing wire mesh clings to the gob-side, the steel straps of the second W-section structure being arranged outside the second reinforcing wire mesh, the high-strength pretensioned yielding bolts of the second W-section structure vertically passing through the steel straps of the W-section structure and the reinforcing wire mesh, and anchor ends of the high-strength pretensioned yielding bolts of the second W-section structure being connected into the gob-side, second cable holes being provided at ends of the steel strap of the second W-section structure, the grouting cable bolts of the second W-section structure passing through the second cable holes and the reinforcing wire mesh, and anchor ends of the grouting cable bolts being connected into the gob-side;

the solid coal seam-side support structure comprising a third reinforcing wire mesh, a reinforced beam and steel strap pallet subassembly, high-strength pretensioned yielding bolts, cable bolts, matching steel straps, and matching cable bolts, wherein the third reinforcing wire mesh clings to the seam-side, the reinforced beam and steel strap pallet subassembly is arranged outside the third reinforcing wire mesh, the high-strength pretensioned yielding bolts vertically pass through the reinforced beam and steel strap pallet subassembly and the third reinforcing wire mesh, anchor ends of the high-strength pretensioned yielding bolts are connected into the seam-side, third cable holes are provided at ends of the steel strap of the solid coal seam-side support structure, the anchor ends of the high-strength pretensioned yielding bolts pass through the third cable holes and the third reinforcing wire mesh, and the anchor ends of the cable bolts of the solid coal seam-side support structure are connected into the seam-side.

2. The asymmetric support structure according to claim 1, further comprising corner bolts with anchor ends arranged in the roadway roof or a roadway floor.

3. The asymmetric support structure according to claim 1, wherein the high-strength pretensioned bolts of the roadway roof support structure are arranged in a row, and a cable bolt is arranged at every other row thereof.

4. The asymmetric support structure according to claim 1, wherein the cable bolts alternate in closeness to the middle of roadway nearby the gob-side, and the grouting cable bolts and the matching steel straps are arranged along a long axis direction of the roadway.

5. The asymmetric support structure according to claim 1, wherein the high-strength pretensioned yielding bolts of the gob-side support structure are in a row, and the grouting cable bolts of the gob-side support structure and its matching steel straps are arranged every two rows thereof; and the high-strength pretensioned yielding bolts of the solid coal seam-side support structure are arranged in a row, and the cable bolts of the solid coal seam-side support structure and the matching steel straps are arranged every two rows thereof.

6. The asymmetric support structure according to claim 1, wherein the grouting cable bolts and the matching steel straps of the gob-side support structure are arranged in a middle-upper part of gob-side; and the cable bolts and the matching steel straps of the solid coal seam-side support structure are arranged in an upper part of seam-side.

7. The asymmetric support structure according to claim 1, wherein a length of the grouting cable bolts of the gob-side support structure is ⅗ of the width of a narrow coal pillar.

8. The asymmetric support structure according to claim 1, wherein the anchor ends of the cable bolts of the seam-side support structure are outside of lateral abutment pressure peaks of adjacent coal faces.

9. The asymmetric support structure according to claim 1, wherein the cable bolts of the roadway roof support structure and the cable bolts of the solid coal seam-side support structure are birdcage cable bolts.

10. A construction method of forming the asymmetric support structure according to claim 1, the construction method comprising the following steps;

Step 1: drilling bolt holes on the roadway roof, arranging the reinforcing wire mesh and W-section steel strap, and mounting the high-strength pretensioned bolts;

Step 2: drilling bolt holes on the gob-side, arranging the reinforcing wire mesh and W-section steel strap, and mounting the high-strength pretensioned yielding bolts;

Step 3: drilling bolt holes on the seam-side, arranging the reinforcing wire mesh, reinforced beam and steel strap pallet subassembly, and mounting the high-strength pretensioned yielding bolts;

Step 4: drilling cable holes on the roadway roof and mounting the steel straps and cable bolts thereon; drilling cable holes on the gob-side and mounting the steel straps and grouting cable bolts thereon; drilling cable holes on the seam-side and mounting the steel straps and cable bolts thereon, and carrying out grouting reinforcement to the grouting cable bolts on the gob-side.

* * * * *